US008056610B2

(12) United States Patent
Hirose et al.

(10) Patent No.: US 8,056,610 B2
(45) Date of Patent: Nov. 15, 2011

(54) SECONDARY COOLING APPARATUS AND CASTING APPARATUS

(75) Inventors: Youichi Hirose, Tsukuba (JP); Hiroshi Nagata, Tsukuba (JP)

(73) Assignee: Ulvac, Inc., Chigasaki-shi (JP)

( * ) Notice: Subject to any disclaimer, the term of this patent is extended or adjusted under 35 U.S.C. 154(b) by 39 days.

(21) Appl. No.: 12/729,597

(22) Filed: Mar. 23, 2010

(65) Prior Publication Data

US 2010/0224341 A1 Sep. 9, 2010

Related U.S. Application Data

(63) Continuation of application No. PCT/JP2008/066963, filed on Sep. 19, 2008.

(30) Foreign Application Priority Data

Sep. 25, 2007 (JP) ..... 2007-246632

(51) Int. Cl.
*B22D 11/124* (2006.01)

(52) U.S. Cl. ..... 164/443; 164/444; 164/485; 164/486

(58) Field of Classification Search ..... 164/443, 164/444, 485, 486; 148/101, 105, 301–303, 148/539

See application file for complete search history.

(56) References Cited

FOREIGN PATENT DOCUMENTS

| | | | |
|---|---|---|---|
| JP | 63-317643 | | 12/1988 |
| JP | 8-269643 | | 10/1996 |
| JP | 9-155507 | | 6/1997 |
| JP | 10-36949 | | 2/1998 |
| JP | 2002-266006 | | 9/2002 |
| JP | 2005-21957 | A1 | 1/2005 |
| JP | 2005021957 | A * | 1/2005 |
| JP | 2005-193295 | A1 | 7/2005 |
| JP | 2006-187777 | A1 | 7/2006 |
| JP | 2006187777 | A * | 7/2006 |
| WO | WO 02072900 | A2 * | 9/2002 |

OTHER PUBLICATIONS

International Search Report for International Application No. PCT/JP2008/066963 dated Oct. 22, 2008.

* cited by examiner

*Primary Examiner* — Jessica L Ward
*Assistant Examiner* — Kevin E Yoon
(74) *Attorney, Agent, or Firm* — Kratz, Quintos & Hanson, LLP

(57) ABSTRACT

A secondary cooling apparatus capable of gradually cooling cast thin pieces and a cast apparatus that uses it are provided. A comb tooth-shaped device is arranged inside a vessel of the secondary cooling apparatus; the cast thin pieces are piled on the comb tooth-shaped device; and crushed small pieces are placed thereon. After the cast thin pieces and the crushed small pieces are gradually cooled, the cast thin pieces are crushed by a pressing device. The crushed small pieces are rapidly cooled by being in contact with a surface of a bottom wall and side faces of cooling teeth. Nd-rich phases or R-rich phases can be annealed by the gradual cooling, and after the crushed small pieces are rapidly cooled to its oxidation temperature or below, the crushed small pieces can be taken out to the air atmosphere.

4 Claims, 8 Drawing Sheets

SECONDARY COOLING APPARATUS AND CASTING APPARATUS

This application is a continuation of International Application No. PCT/JP2008/066963 filed Sep. 19, 2008, which claims priority to Japanese Patent Document No. 2007-246632, filed on Sep. 25, 2007. The entire disclosures of the prior applications are herein incorporated by reference in their entireties.

BACKGROUND

The present invention relates to a cooling apparatus and cooling method for cast thin pieces in a strip casting method as a method for producing a raw material alloy for a neodymium-iron-boron based sintered magnet. More particularly, the invention relates to the cooling apparatus and the cooling method in which a value of cooling velocity in a high temperature region can be changed.

BACKGROUND ART

With high performance and miniaturization in electronics devices including personal computers and peripheral devices thereof, demands for neodymium-iron-boron based sintered magnets (hereinafter referred to as neodymium based magnets) having high performance have been recently increasing. Further, in order to reduce power consumptions in home electronics (such as, air conditioners, refrigerators or the like), or for electric cars of a hybrid type or the like, motors having higher efficiency have been in demand. A demand for the neodymium based magnets has also been increasing in these fields.

On the other hand, characteristics of the neodymium based magnets have improved. Technologies for improving the characteristics have been broadly classified into two. One of them relates to a tissue control for the raw material alloys. The other relates to improvement in a technology for the production of magnets.

In order to improve the characteristics of the magnet, the production steps of the magnets are not only to be improved, but also techniques for producing magnet alloys as raw materials are important considerations.

For example, in the case of the neodymium based magnets of which the production amount is the highest among rare earth magnets, an $Nd_2Fe_{14}B$ phase as a supporter of a magnetic property is produced from a liquid phase by a peritectic reaction in a Nd—Fe—B ternary system equilibrium diagram. For this reason, as the magnet alloy approaches a stoichiometric composition of the $Nd_2Fe_{14}B$ phase having particularly higher performance, primary crystals of γFe are more easily produced at the time of melting and casting.

Since this γFe phase is produced in a dendrite morphology, and join in three dimensions, it conspicuously damages the crushability characteristic of an ingot so that the powder obtained in the crushing step in the steps for producing a magnet exhibit a disturbed grain diameter distribution or a deviated composition.

In order to avoid such a problem, a strip casting method (hereinafter referred to as SC method) which can speed up the solidification rate on casting has been recently adopted, wherein a raw material melted in a crucible is cooled by a cooling roller, and a cast thin piece having a thickness of about 0.3 mm is obtained. After the cast thin piece is finely crushed with a crusher, crushed pieces are placed in a receiving vessel, and taken out from a casting apparatus after cooling.

When the cooling on the cooling roller is classified into a primary cooling and the cooling of the cast thin piece released from the cooling roller is classified into a secondary cooling, the value of cooling velocity in an ordinary secondary cooling is regulated by cooling with an inert gas (such as, an Ar gas or the like) between the cooling roller and the cast piece receiving box, alternatively cooling during the carriage with a conveyer or belt, or further by cooling with the inert gas inside the cast piece receiving vessel. In addition, a method in which the cast pieces are cooled by being sandwiched with two pairs of rotating belts, or a method in which they are put directly into liquid Ar, and other methods are carried out. Combinations of these methods may suffice.

However, when the value of cooling velocity in the high temperature range is controlled, cooling becomes slower as a temperature difference decreases if cooling is down to a low temperature range by the same method, so that even when the cast thin pieces are taken out from a chamber, the time for them to go down to such a temperature and causing no oxidation problem becomes long. A concrete solution for such a problem has not been known.

On the other hand, a method is proposed in which intervals between Rare earths rich phases (R-rich phases) are widened to 3 to 15 μm by setting the average value of cooling velocity between 800 to 600 degrees Celsius at 1.0 degrees Celsius/second or below. For example, a melt of a rare earth element-containing alloy is made to follow onto a cooled rotary roller inside a chamber in a vacuum or in an inert gas ambience; and immediately after it is solidified in a ribbon shape by cooling, the solidified thin ribbon is crushed into pieces, the crushed alloy pieces being received in a receiving vessel placed in the chamber; and the value of the cooling velocity of the crushed alloy pieces is controlled with a cooling medium.

As a specific method, cooling partition plates are provided inside the receiving vessel, and the value of cooling velocity of the crushed alloy pieces is controlled by the flow of a gas or liquid therein as a cooling medium.

However, when the gas is used as the cooling medium in this method, the heat capacity of the gas per volume is extremely small, so that a large amount of the gas needs to be introduced. In case that the inert gas is used as the cooling gas, although it can directly flow through among the stacked cast thin pieces, large diameter pipes are placed around, and a heat exchanger having a sufficiently wide heat conduction area, which recovers the heated gas and cools and returns it, is necessary, thereby making the equipment bulky. Furthermore, the time required for cooling becomes longer.

Although an example of using air as a gas is shown, partition plates with a sealed structure need to be provided in this case. However, since the heat capacity per volume of air is small, partition plates having an extremely large heat conduction area through which a large amount of air is introduced are required in order to increase the value of cooling velocity, and the cast thin pieces are placed in gaps thereof. Therefore, the receiving vessel becomes considerably large particularly in the apparatus of a mass production scale. Furthermore, in order that the vessel may be taken in and out of the casting chamber or that the cast thin pieces falling from the cooling roller may be placed evenly in the vessel, the vessel needs to have a structure capable of being moved. Thus, it is difficult to place the large diameter pipes around such a receiving vessel and feed a large amount of air, from the standpoint of reliability in the equipment. More particularly, since the rare earth containing alloy is chemically extremely active, an apparatus which handles the cast thin pieces made of such an active alloy and having a large specific surface at a high temperature also faces a large problem from the standpoint of safety.

Moreover, when water is used as the cooling medium, if water is introduced after casting, water directly flows into the partition plates at a high temperature state, which causes a rapid boiling phenomenon and poses a safety problem.

Furthermore, heat impact upon the partition plates is too large, which causes cracking and deformation due to heat strain and poses a drawback in the durability of the partition plate. Specifically, if the partition plate is broken, the leaked water and the cast thin pieces at a high temperature react to generate hydrogen, which causes a serious safety problem. If water is introduced prior to starting the casting so as to avoid such a problem, the cooling power is so large that it is difficult to attain a slow cooling condition aimed at the high temperature range.

A method is disclosed in which a receiving vessel having cast thin pieces placed therein is moved to another chamber, and cooled by using an inert gas or the like (see, e.g., JPA 2002-266006). According to this method, the cooling in the high temperature range is generally slow. However, this cooling method is not aimed at controlling the tissue of the alloy, so that the value of cooling velocity cannot be regulated. Moreover, cooling is also slow in a low temperature range, so that a long time period is required to lower the cast thin pieces to such a temperature as to allow them to be open to the atmosphere. Therefore, a large number of receiving vessels are required. These problems are disclosed in JPA 63-317643, JPA 8-269643, JPA 9-155507 JPA 10-36949 and JPA 2005-193295.

As explained above, in the SC method for the alloy of the neodymium based magnet, it is important to control the value of cooling velocity on the cooling roller as well as the value of cooling velocity after the cast thin piece is released from the cooing roller, and particularly the value of cooling velocity in a temperature range in which R-rich phases are dissolved immediately after the cast thin piece is released from the cooling roller. In order to regulate the value of cooling velocity in such a temperature range that may be appropriately small and the tissue of the alloy may be controlled to meet the required characteristics of the magnet, an apparatus and a method are required to arbitrarily regulate the value of cooling velocity and thereafter to cool the cast thin pieces in a short time period so as to enhance productivity. In addition, the apparatus is to handle the rare earth alloy being extremely active and having a large specific area, and it needs to be an equipment which fully considers the heat stress, strain, corrosion, etc. not only from the standpoint of the tissue control but also from the standpoint of safety. Such a highly reliable apparatus has not been known yet.

The present invention is aimed to provide a compact cooling apparatus and a cooling method, which have high safety features and can freely control the cooling condition in performing an optimum tissue control for a raw material alloy of a neodymium based sintered magnet having a high performance characteristic.

SUMMARY OF THE INVENTION

In order to solve the above problem, the present invention is directed to a secondary cooling apparatus, including a vessel, a comb tooth-shaped device in which a plurality of plate-like cooling teeth are provided upright at a predetermined interval, a pressing device having a plurality of pressing teeth to be inserted between the cooling teeth, and cooling pipes provided on the cooling teeth and through which a liquid cooling medium is made to flow.

Further, the present invention is directed to the secondary cooling apparatus, wherein the vessel is formed in a bottomed cylindrical shape, and the cooling teeth are each formed in a ring-like shape and concentrically arranged.

Furthermore, the present invention is directed to a casting apparatus, which includes a crucible in which a melt of a raw material is placed, a primary cooling apparatus for cooling the melt fed from the crucible and forming plate-like cast thin pieces, and any of the secondary apparatuses as discussed above, wherein the cast thin pieces are fed into the secondary cooling device.

Furthermore, the present invention relates to the casing apparatus, which further includes a crushing device for crushing the cast thin pieces and forming crushed small pieces, wherein both the cast thin piece and the crushed small pieces can be fed to the secondary cooling apparatus.

In the conventional apparatuses, the SC material is too rapidly cooled after being released from the roller, and there are large variations among the SC materials released from the roller.

In the present invention, since the value of cooling velocity of the cast thin piece and crushed small pieces is small, the distribution state of Nd-rich phases change and is converted to a state in which so-called annealing proceeds (i.e., the average distance between the Nd-rich phases becomes longer).

In the state such that the cast thin piece or the crushed small pieces reach a predetermined temperature, the pressing member is pressed thereinto from above the cast thin piece or the crushed small pieces, so that the cast thin piece is crushed in order to drop the crushed small pieces between the cooling combs.

The crushed small pieces need to be cooled to 150 degrees Celsius or lower at which the oxidation thereof will not proceed even when taken out to the atmosphere. Since the value of cooling velocity of the crushed small pieces falling between the cooling teeth becomes larger, they can be cooled to a temperature of 150 degrees Celsius or below in a short time period, so that the productivity can be improved.

In addition, the tissues of the crushed small pieces can be controlled by changing the time period during which they are held on the cooling teeth.

After the melt is rapidly cooled with the cooling roller and the cast thin piece or the crushed small pieces are formed, they can be cooled in the state such that they are put on the secondary cooling apparatus. Thus, the value of cooling velocity when the melt is solidified is large; and the value of cooling velocity at the time when they are cooled from 800 degrees Celsius to 600 degrees Celsius becomes small, so that the distributed state of the R-rich phases can be controlled.

Moreover, when the temperature is lower than 600 degrees Celsius, the cast thin piece or the crushed small pieces can be rapidly cooled with the secondary cooling apparatus, so that they can be taken out to the air atmosphere at a temperature of 150 degrees Celsius or lower within short time period and the crushed small pieces will not be oxidized.

BRIEF DESCRIPTION OF THE DRAWINGS

FIG. 3(*a*) is a plan view and FIG. 3(*b*) is a sectional view thereof cut along an A-A line in FIG. 3(*a*).

FIG. 4(*a*) is a plan view and FIG. 4(*b*) is a sectional view cut along a B-B line in FIG. 4(*a*).

FIG. 5(*a*) is a plan view and FIG. 5(*b*) is a sectional view cut along a line C-C in FIG. 5(*a*).

DETAILED DESCRIPTION OF THE INVENTION

Figure 1:
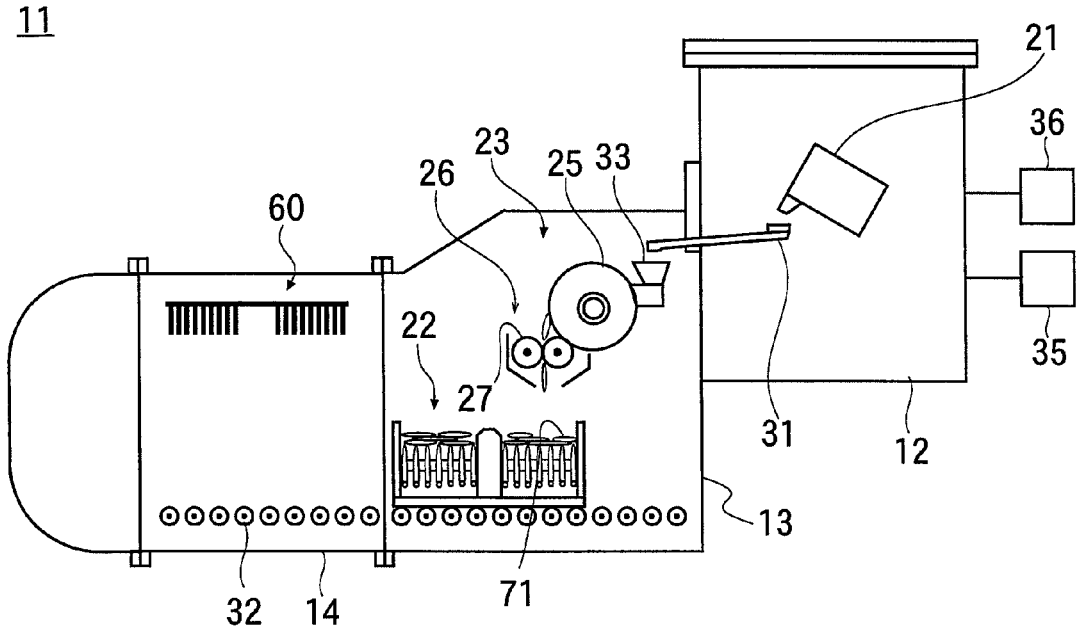
FIG. 1 is a first figure for illustrating a casting apparatus of the present invention.
Figure 2:
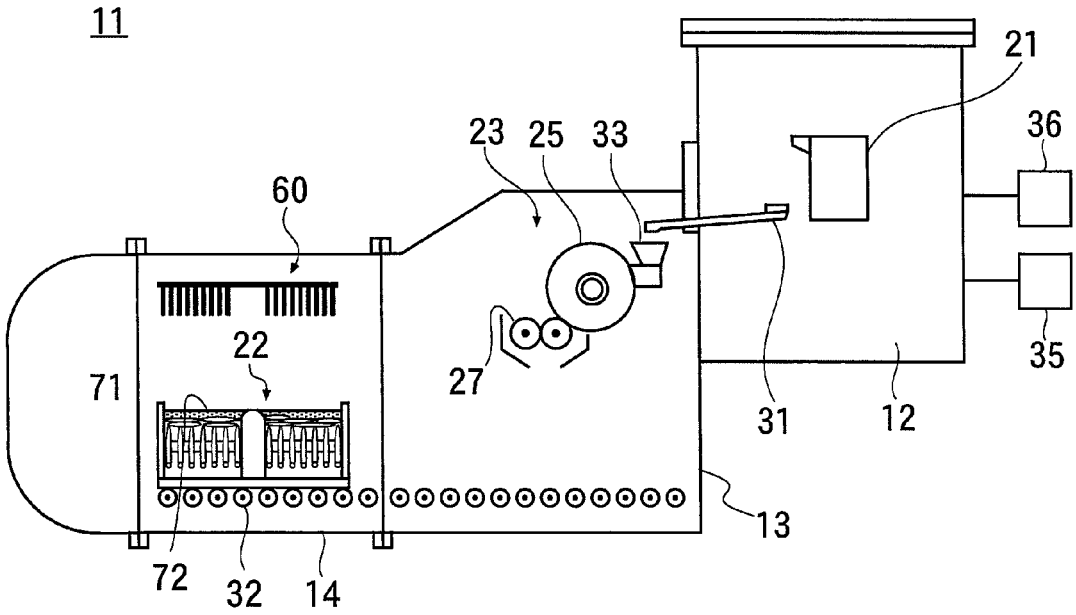
FIG. 2 is a second figure for illustrating the casting apparatus of the present invention.

In FIG. 1, a reference numeral 11 denotes one embodiment of the casting apparatus of the present invention, which includes a melting chamber 12, a collection chamber 13 and a cooling chamber 14.

A vacuum evacuation system 35 and a gas introduction system 36 are connected to the casting apparatus 11. After the interior of each of the chambers 12 to 14 is vacuum evacuated by the vacuum evacuation system 35, an inert gas (here, argon) is introduced from the gas introduction system 36, so that the interior of each of the chambers 12 to 14 is set in an inert gas ambience.

The collection chamber 13 is connected to the melting chamber 12, and the cooling chamber 14 is connected to the collection chamber 13.

Transfer rollers 32 are arranged on the bottom walls of the collection chamber 13 and the cooling chamber 14; and a secondary cooling apparatus 22 is placed on the transfer rollers 32 in the collection chamber 13.

A primary cooling apparatus 23 is arranged at a position above the secondary cooling apparatus 22 inside the collection chamber 13.

A melt trough 31 is arranged between the melting chamber 12 and the collection chamber 13, bridging the interior of the melting chamber 12 and the interior of the collection chamber 13.

A crucible 21 is arranged inside the melting chamber 12, raw materials of a neodymium-iron-boron based sintered magnet being charged into the crucible 21 at predetermined compounding rates.

The melting chamber 12 is provided with a heater; and a melt is formed by heating and melting the raw materials placed inside the crucible 21 to be around 1400 degrees Celsius in the inert gas ambience.

Next, when the melt is poured into the melt trough 31 by tilting the crucible 21, the melt flows inside the melt trough 31, and is poured into a receiving tray 33 (tundish) of the primary cooling apparatus 23.

The primary cooling apparatus 23 includes a cooling roller 25 and a crushing device 26. The cooling roller 25 has water passage in which cooling water is passed. The cooling roller 25 is rotated in the state such that it is cooled with water. The melt poured into the receiving tray 33 contacts the cooling roller 25, and is placed on the cooling roller 25 through the rotation thereof, and carried to a place where the crushing device 26 is arranged, while being cooled.

At such time, the melt is solidified by cooling to form a cast thin piece in a thin sheet-like form. The cast thin piece is released from the cooling roller 25 through the rotation thereof, and drops into the interior of the crushing device 26. The thickness of the cast thin piece is around 0.3 mm.

Two crushing rollers 27 are arranged inside the crushing device 26.

A moving device is connected to the crushing rollers 27 so that the position of one or both of the crushing rollers 27 can be moved.

When the two crushing rollers 27 are made to closely contact and the cast thin piece is dropped onto the crushing rollers 27 while the crushing rollers 27 are being rotated, the cast thin piece is crushed to crushed small pieces near to powder form, which drop under the primary cooling apparatus 23.

When the crushing rollers 27 are spaced apart or the crushing rollers 27 are moved from the position where the cast thin piece drops, the cast thin piece dropped from the cooling roller 25 drops under the primary cooling apparatus 23 without being crushed.

Meanwhile, it may be that when a detour is formed and after the cast thin piece dropped from the cooling roller 25 passes the detour, the cast thin piece drops from the primary cooling apparatus 23, and the cast thin piece passes the crushing device 26 without passing the detour, and then, the crushed small pieces may drop.

The cast thin piece and the crushed small pieces dropping and fed from the primary cooling apparatus 23 drop into the secondary cooling apparatus 22.

Figure 5A:
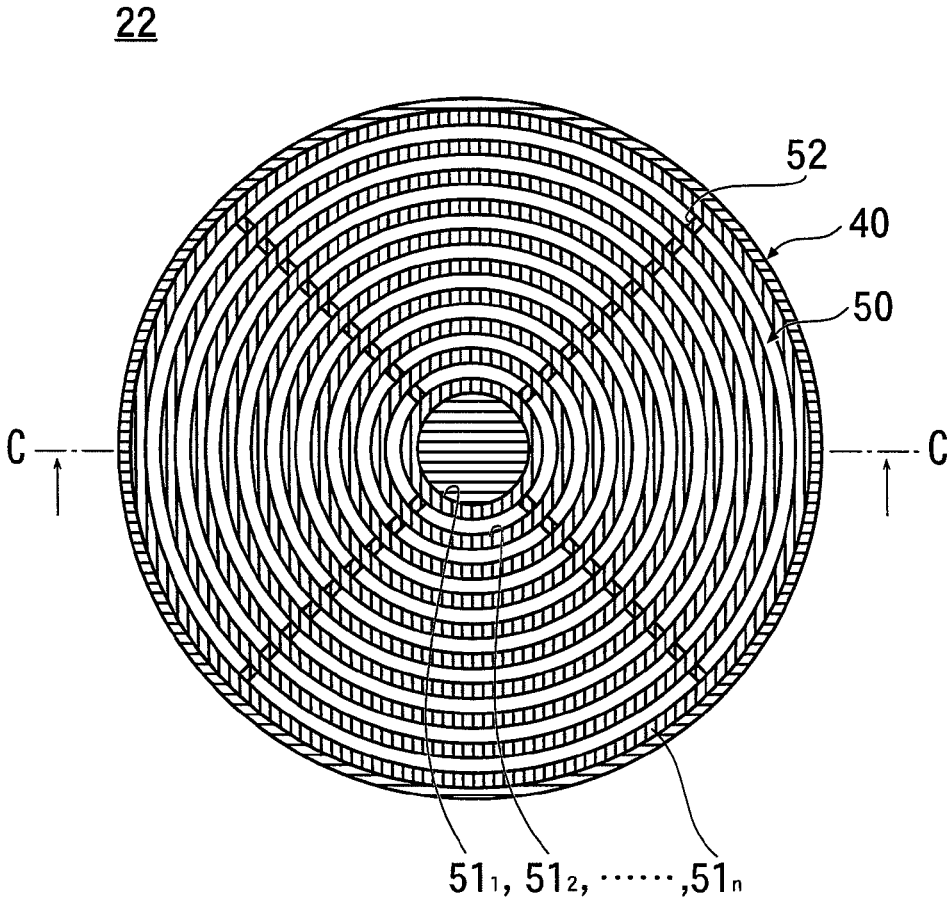
FIG. 5(*a*) and FIG. 5(*b*) illustrate a secondary cooling apparatus.
Figure 5B:
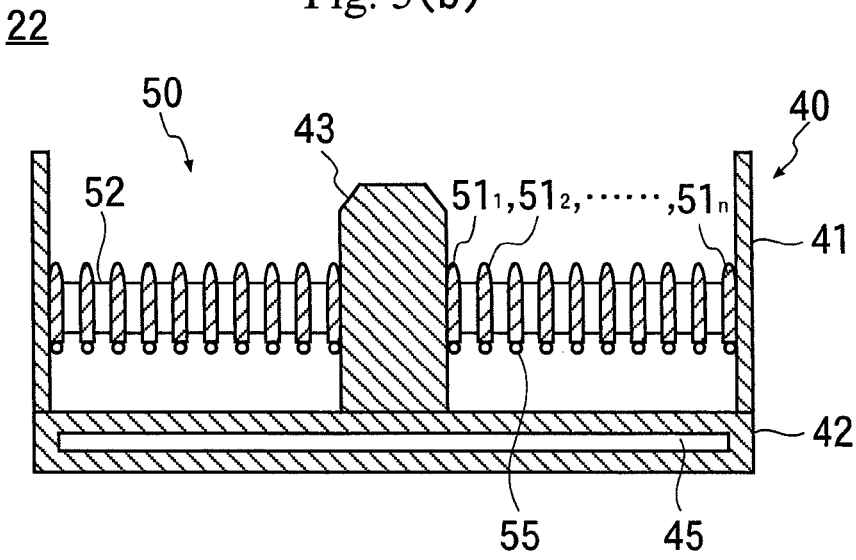

FIGS. 5(*a*) and (*b*) are figures for illustrating the secondary cooling apparatus 22, and FIG. 5(*a*) is a plan view thereof, and FIG. 5(*b*) is a sectional view cut along a C-C line in FIG. 5(*a*). The secondary cooling apparatus 22 includes a vessel 40 and a comb tooth-shaped device 50.

Figure 3:
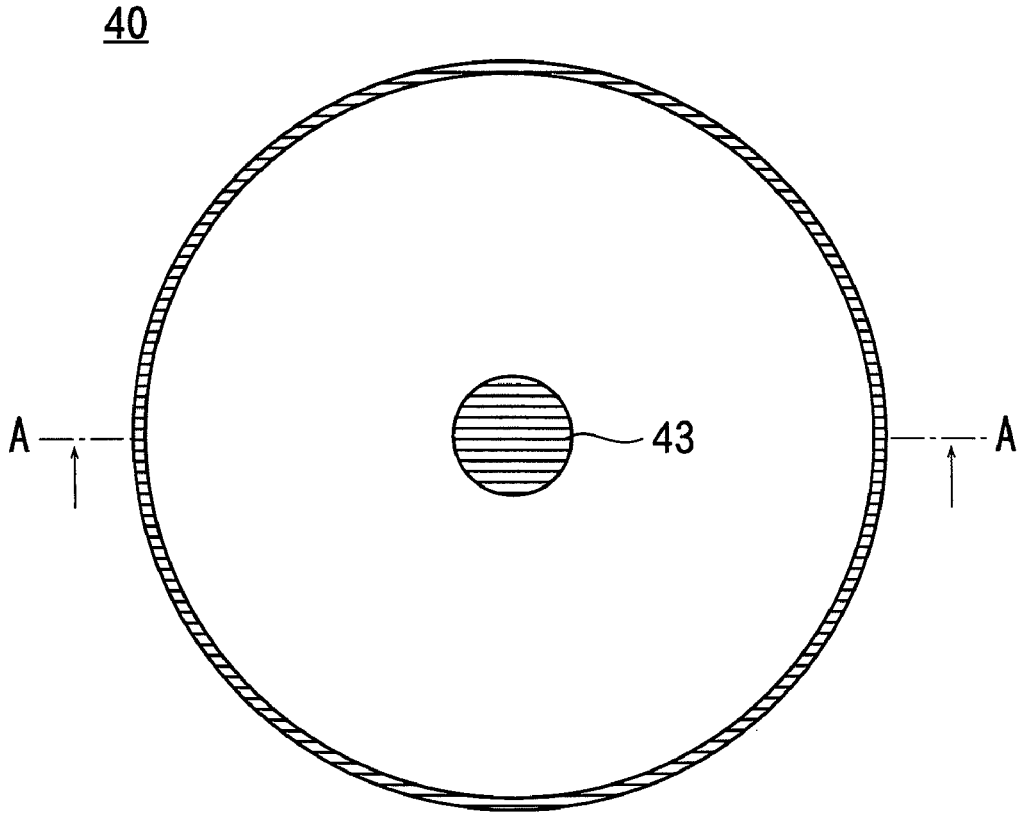
FIGS. 3(*a*) and 3(*b*) illustrate a vessel.
Figure 3:
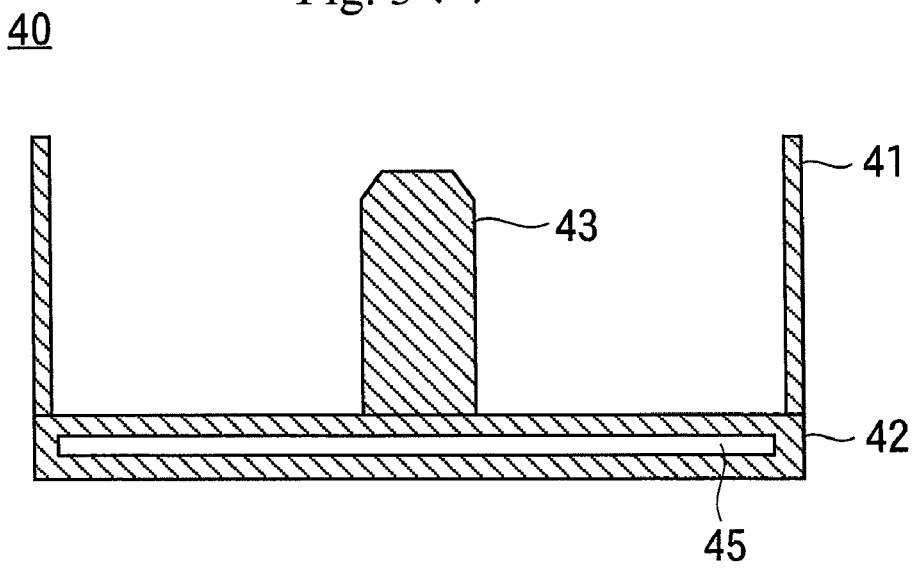

FIGS. 3(*a*) and (*b*) are figures for illustrating the vessel 40, FIG. 3(*a*) is a plane view thereof, and FIG. 3(*b*) is a sectional view cut along an A-A line in FIG. 3(*a*). The vessel 40 has a bottomed cylindrical shape, and includes a cylindrical peripheral wall 41, a bottom wall 42 closing one end of the peripheral wall 41, and a guide rod 43 is provided upright at a central location of the bottom wall 42.

Figure 4:
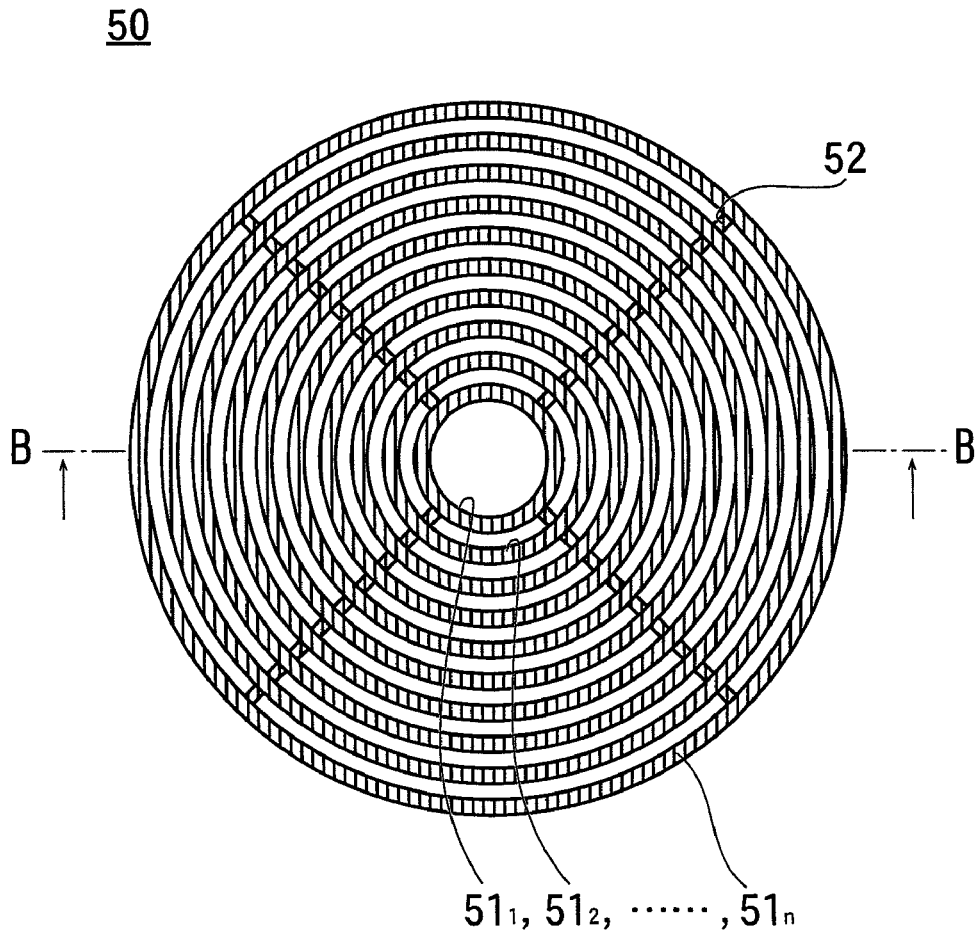
FIGS. 4(*a*) and 4(*b*) illustrate a comb tooth-shaped device.
Figure 4B:
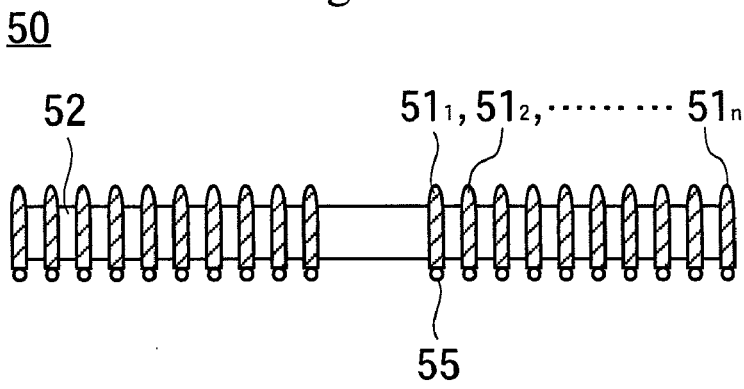

FIGS. 4(*a*) and (*b*) are figures for illustrating the comb tooth-shaped device 50, FIG. 4(*a*) is a plan view, and FIG. 4(*b*) is a sectional view cut along a B-B line in FIG. 4(*a*). The comb tooth-shaped device 50 has a plurality of cooling teeth $\mathbf{51}_1, \mathbf{51}_2, ---, \mathbf{51}_n$. Each of the cooling teeth $\mathbf{51}_1, \mathbf{51}_2, ---, \mathbf{51}_n$ is in a ring shape, and they are concentrically arranged, while being spaced at a predetermined interval, and mutually fixed by connecting plates 52.

The inner diameter of the cooling tooth $\mathbf{51}_1$ at the innermost circle is set larger than the outer diameter of the guide rod 43, whereas the outer diameter of the cooling tooth $\mathbf{51}_n$ at the outermost circle is set smaller than the inner diameter of the peripheral wall 41 of the vessel 40. The comb tooth-shaped device 50 is disposed inside the vessel 40 in the state such that the comb tooth-shaped device is inserted through the guide rod 43. In the state such that the comb tooth-shaped device 50 is disposed inside the vessel 40, each of the cooling teeth $\mathbf{51}_1, \mathbf{51}_2, ---, \mathbf{51}_n$ does not contact the bottom wall 42 of the vessel 40, while a space is formed therebetween. Further, in this state, the cooling teeth $\mathbf{51}_1, \mathbf{51}_2, ---, \mathbf{51}_n$ are vertical to the bottom wall 42.

When the melt inside the crucible 21 is introduced into the primary cooling apparatus 23 and the cast thin piece is formed, the crushing rollers 27 are first moved as discussed above, and the cast thin piece is dropped to the secondary cooling apparatus 22 without being crushed.

The interval of the cooling teeth $\mathbf{51}_1$, $\mathbf{51}_2$, - - - , $\mathbf{51}_n$ is set more closely (30 to 100 mm, more desirably 50 to 70 mm) than the size of the cast thin piece, and the cast thin piece dropped inside the secondary cooling apparatus 22 is placed on the cooling teeth $\mathbf{51}_1$, $\mathbf{51}_2$, - - - , $\mathbf{51}_n$ so as to cover spaces between the cooling teeth $\mathbf{51}_1$, $\mathbf{51}_2$, - - - , $\mathbf{51}_n$.

Figure 6:
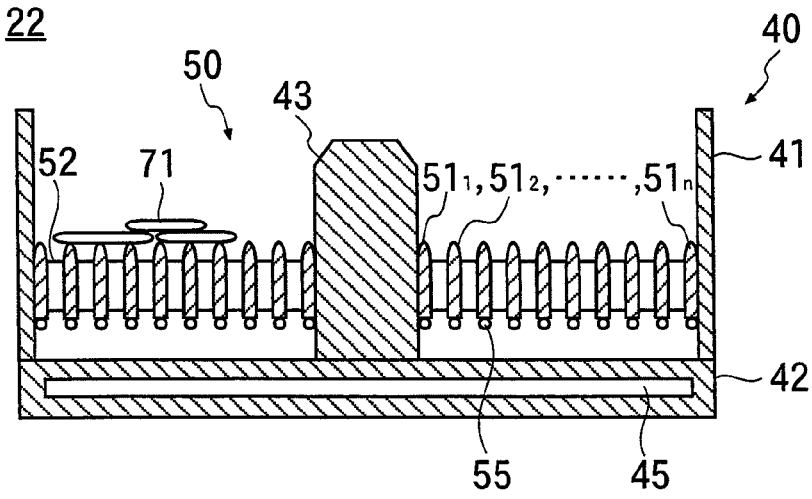
FIG. 6 is a first figure for illustrating a gradually cooling step.

In FIG. 6, a reference numeral 71 denotes the cast thin piece placed on the cooling teeth $\mathbf{51}_1$, $\mathbf{51}_2$, - - - , $\mathbf{51}_n$.

Figure 7:
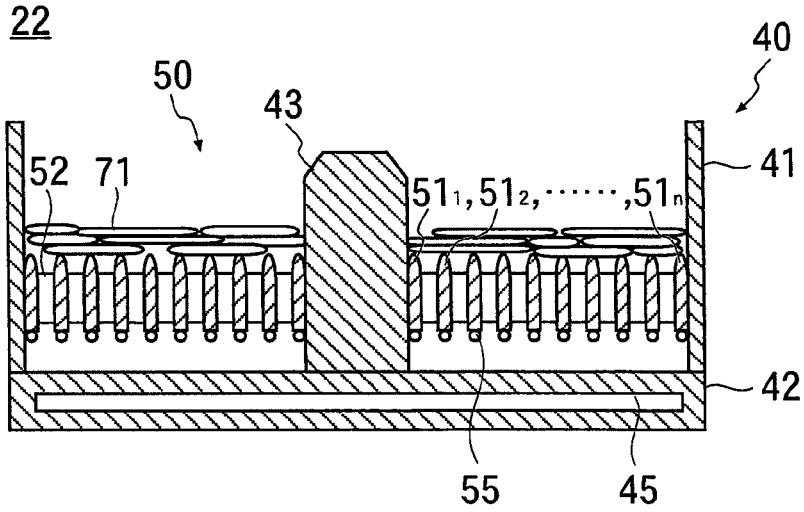
FIG. 7 is a second figure for illustrating a gradually cooling step.

A motor is connected to the vessel 40 in which the comb tooth-shaped device 50 is arranged; and the vessel 40 is rotated while the cast thin pieces 71 are being dropped from the primary cooling apparatus 23. The comb tooth-shaped device 50 is also rotated following the rotation of the vessel 40, and the cast thin pieces 71 are placed all over the entire peripheries of the cooling teeth $\mathbf{51}_1$, $\mathbf{51}_2$, - - - , $\mathbf{51}_n$. Accordingly, as shown in FIG. 7, the upper sides of the cooling teeth $\mathbf{51}_1$, $\mathbf{51}_2$, - - - , $\mathbf{51}_n$ are covered with the cast thin pieces 71 without a gap.

Next, the crushing device 26 is set to a state for crushing the cast thin piece by narrowing the interval between the two crushing rollers 27; the cast thin piece 71 is fed from the cooling roller 25 to the crushing device 26 for crushing; and the crushed small pieces are dropped into the secondary cooling apparatus 22. The crushed small pieces are stacked on the cast thin pieces 71.

Figure 8:
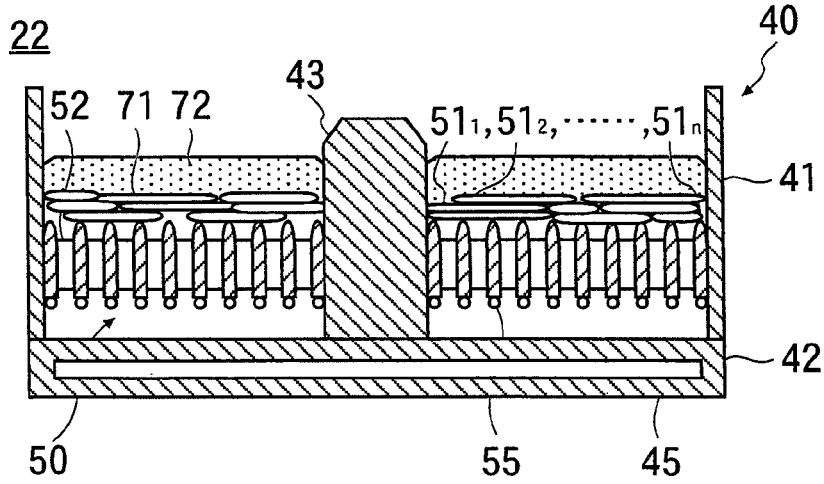
FIG. 8 is a third figure for illustrating a gradually cooling step.

In FIG. 8, a reference numeral 72 denotes the crushed small pieces stacked on the cast thin pieces 71.

After the melt inside the crucible 21 is entirely moved into the secondary cooling apparatus 22 as the cast thin pieces 71 and the crushed small pieces 72, the secondary cooling apparatus 22 is moved from the collection chamber 13 into the cooling chamber 14 by rotating the transfer rollers 32.

The pressing device 60 is arranged in an upper side of the cooling chamber 14.

The secondary cooling apparatus 22 is stopped under the pressing device 60.

Figure 9:
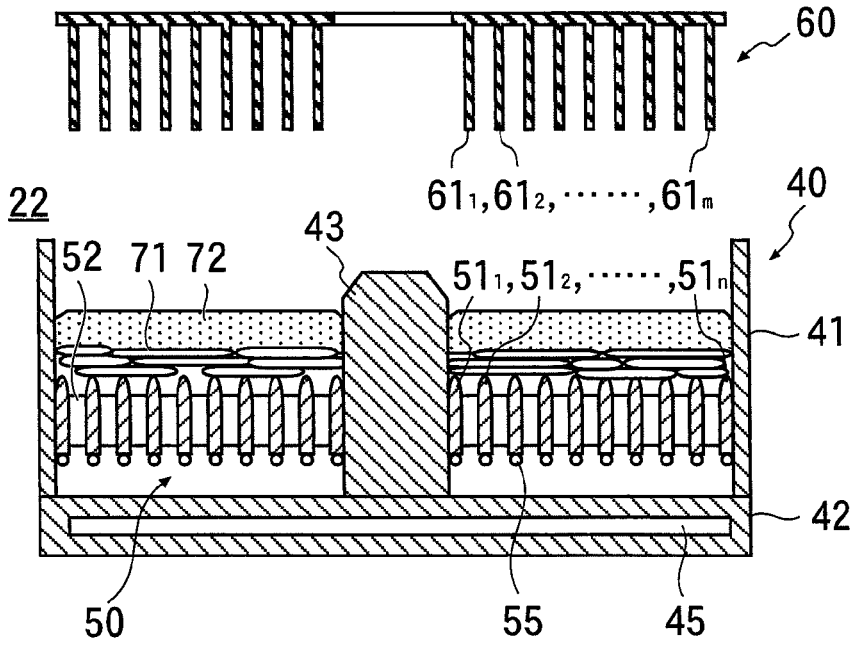
FIG. 9 is a first figure for illustrating a step to transfer from the gradual cooling to the rapid cooling.

The cast thin pieces 71 are placed on the upper ends of the cooling teeth $\mathbf{51}_1$, $\mathbf{51}_2$, - - - , $\mathbf{51}_n$, and since a contact area between the cast thin pieces and the cooling teeth $\mathbf{51}_1$, $\mathbf{51}_2$, - - - , $\mathbf{51}_n$ is small, the cast thin pieces 71 and the crushed small grains 72 thereon are gradually cooled inside the cooling chamber having the inert gas filled therein (gradual cooling). At this time, a cooling medium is introduced through a cooling pipe 45, as discussed later. The pressing device 60 has a plurality of pressing teeth $\mathbf{61}_1$, $\mathbf{61}_2$, - - - , $\mathbf{61}_m$, as shown in FIG. 9.

The interval of the pressing teeth $\mathbf{61}_1$, $\mathbf{61}_2$, - - - , $\mathbf{61}_m$ is set to the same interval as for the cooling teeth $\mathbf{51}_1$, $\mathbf{51}_2$, - - - , $\mathbf{51}_n$, and the respective pressing teeth $\mathbf{61}_1$, $\mathbf{61}_2$, - - - , $\mathbf{61}_m$ are arranged above the positions of the spaces between the cooling teeth $\mathbf{51}_1$, $\mathbf{51}_2$, - - - , $\mathbf{51}_n$ and the cooling teeth $\mathbf{51}_1$, $\mathbf{51}_2$, - - - , $\mathbf{51}_n$.

Figure 10:
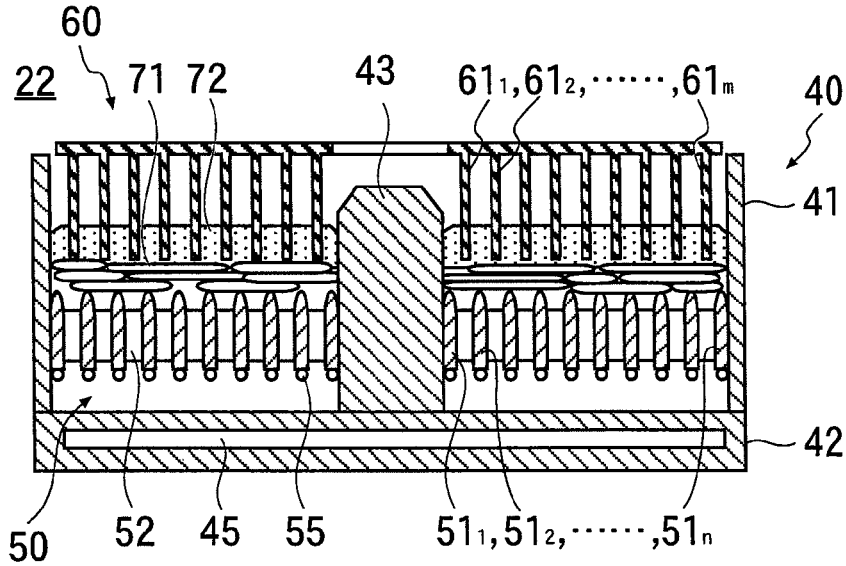
FIG. 10 is a second figure for illustrating a step to transfer from the gradual cooling to the rapid cooling.
Figure 11:
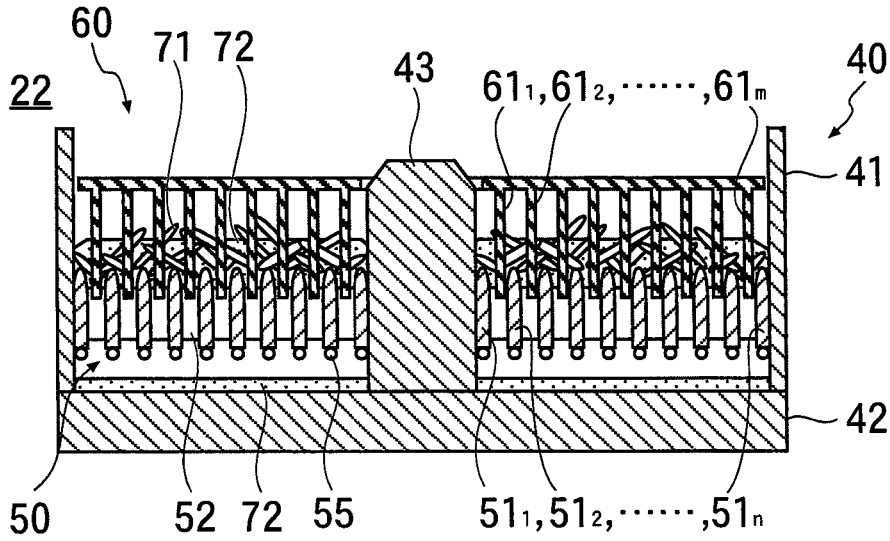
FIG. 11 is a third figure for illustrating a step to transfer from the gradual cooling to the rapid cooling.

After the cast thin pieces 71 and the crushed small pieces 72 are cooled to a predetermined temperature, the pressing device 60 is lowered so as to contact the ends of the pressing teeth $\mathbf{61}_1$, $\mathbf{61}_2$, - - - , $\mathbf{61}_m$ with the cast thin pieces 71, as shown in FIG. 10, and further lowered. As a result, as shown in FIG. 11, the pressing teeth $\mathbf{61}_1$, $\mathbf{61}_2$, - - - , $\mathbf{61}_m$ are inserted between the cooling teeth $\mathbf{51}_1$, $\mathbf{51}_2$, - - - , $\mathbf{51}_n$, while crushing the cast thin pieces 71 positioned on the cooling teeth $\mathbf{51}_1$, $\mathbf{51}_2$, - - - , $\mathbf{51}_n$ (here, m=n−1, and the pressing teeth $\mathbf{61}_1$, $\mathbf{61}_2$, - - - , $\mathbf{61}_m$ are inserted between the cooling teeth $\mathbf{51}_1$, $\mathbf{51}_2$, - - - , $\mathbf{51}_n$ one by one).

Since the cast thin pieces 71 are crushed so as to become crushed small pieces 72, which are smaller than the gaps between the cooling teeth $\mathbf{51}_1$, $\mathbf{51}_2$, - - - , $\mathbf{51}_n$, they are pushed in between the cooling teeth $\mathbf{51}_1$, $\mathbf{51}_2$, - - - , $\mathbf{51}_n$ together with the crushed small pieces 72 stacked on the cast thin pieces 71, so that they fill up the gap between the lower ends of the cooling teeth $\mathbf{51}_1$, $\mathbf{51}_2$, - - - , $\mathbf{51}_n$ and the bottom wall 42, and between the cooling teeth $\mathbf{51}_1$, $\mathbf{51}_2$, - - - , $\mathbf{51}_n$.

The pressing teeth $\mathbf{61}_1$, $\mathbf{61}_2$, - - - , $\mathbf{61}_m$ are moved up and down and the pressing teeth $\mathbf{61}_1$, $\mathbf{61}_2$, - - - , $\mathbf{61}_m$ are repeatedly inserted into and removed from the gaps between the cooling teeth $\mathbf{51}_1$, $\mathbf{51}_2$, - - - , $\mathbf{51}_n$ so that the cast thin pieces 71 may be fully crushed and contacted with the peripheral faces of the cooling teeth $\mathbf{51}_1$, $\mathbf{51}_2$, - - - , $\mathbf{51}_n$ and the surface of the bottom wall 42.

Figure 12:
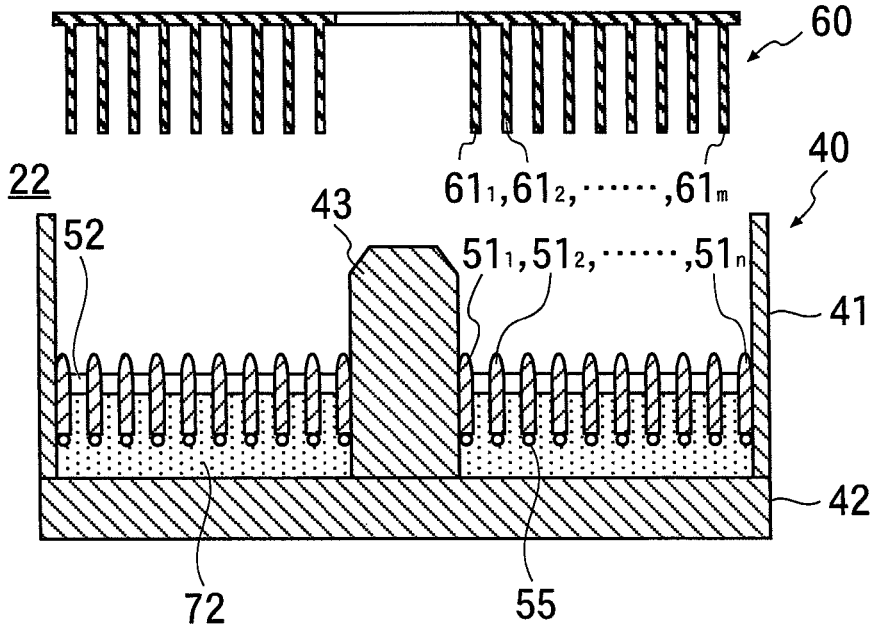
FIG. 12 is a figure for illustrating a rapidly cooling step.

FIG. 12 shows a state whereby the pressing device 60 is moved upwardly and pulled out from the secondary cooling apparatus 22. In this state, the crushed small pieces 72 are in contact with the bottom wall 42 and the peripheral faces of the cooling teeth $\mathbf{51}_1$, $\mathbf{51}_2$, - - - , $\mathbf{51}_n$.

The bottom wall 42 and the cooling teeth $\mathbf{51}_1$, $\mathbf{51}_2$, - - - , $\mathbf{51}_n$ are provided with cooling pipes 45 and 55, respectively. The cooling pipes 45, 55 are connected to a cooler so that a liquid cooling medium can be introduced therein. In this embodiment, water is used as the cooling medium.

The cast thin pieces 71 and the crushed small pieces 72 are not rapidly cooled in such a state that the cast thin pieces 71 and the crushed small pieces 72 are placed on the cooling teeth $\mathbf{51}_1$, $\mathbf{51}_2$, - - - , $\mathbf{51}_n$.

When the crushed small pieces 72 are cooled in such a state that the crushed small pieces 72 are in contact with the bottom wall 42 and the peripheral faces of the cooling teeth $\mathbf{51}_1$, $\mathbf{51}_2$, - - - , $\mathbf{51}_n$ after the pressing teeth $\mathbf{61}_1$, $\mathbf{61}_2$, - - - , $\mathbf{61}_m$ are inserted between the cooling teeth $\mathbf{51}_1$, $\mathbf{51}_2$, - - - , $\mathbf{51}_n$, the bottom wall 42 and the cooling teeth $\mathbf{51}_1$, $\mathbf{51}_2$, - - - , $\mathbf{51}_n$ are cooled so that the crushed small pieces 72, which are in contact with them, are rapidly cooled.

The cooling pipe 55 provided on the cooling teeth $\mathbf{51}_1$, $\mathbf{51}_2$, - - - , $\mathbf{51}_n$ is positioned at lower ends of the cooling teeth $\mathbf{51}_1$, $\mathbf{51}_2$, - - - , $\mathbf{51}_n$, and since the crushed small pieces 72 pushed in between the cooling teeth $\mathbf{51}_1$, $\mathbf{51}_2$, - - - , $\mathbf{51}_n$ by the pressing device 60 are in contact with the peripheral faces of the lower ends of the cooling teeth $\mathbf{51}_1$, $\mathbf{51}_2$, - - - , $\mathbf{51}_n$, they are effectively cooled.

Figure 13:
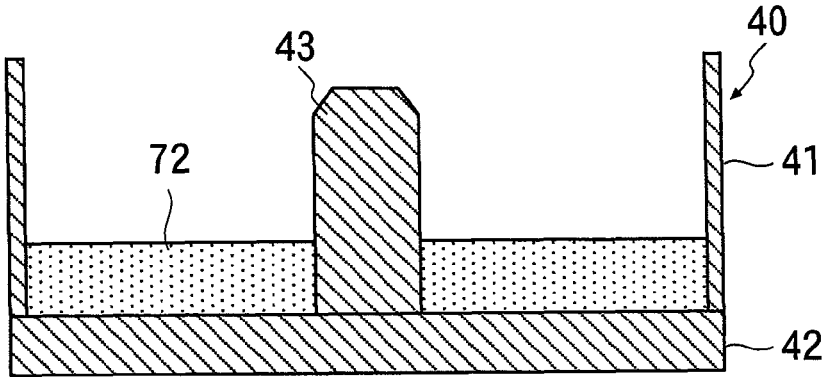
FIG. 13 is a figure for illustrating a state in which the crushed small pieces are taken out of the casting apparatus.

The crushed small pieces 72 are cooled in the state such that the pressing device 60 is pulled out from the secondary cooling apparatus 22, and when the crushed small pieces 72 are cooled to around 150 degrees Celsius, the comb tooth-shaped device 50 is taken out from the interior of the vessel 40, as shown in FIG. 13. Thereafter, when the vessel 40 in which the crushed small pieces 72 are placed is taken out from the casting apparatus 11, a raw material for the neodymium-iron-boron based sintered magnet is obtained.

Meanwhile, in the above embodiment, the cooling teeth $\mathbf{51}_1$, $\mathbf{51}_2$, - - - , $\mathbf{51}_n$ are ring shapes, and a plurality of the cooling teeth $\mathbf{51}_1$, $\mathbf{51}_2$, - - - , $\mathbf{51}_n$ are arranged concentrically. However, the present invention is not limited thereto, and it may be that a plurality of cooling teeth are arranged spaced apart and the cast thin pieces are placed and gradually cooled on them, so that the cast thin pieces are pushed in between the cooling teeth after the gradual cooling, and rapidly cooled. For example, a plurality of flat plate-like cooling teeth can be provided upright in parallel to one another.

Furthermore, in the present invention, a spraying device is arranged above the secondary cooling device 22, and the cast thin pieces 71 and the crushed small pieces 72 are sprayed onto the secondary cooling apparatus 22 so that they can be arranged uniformly.

Since the thickness of the cast thin piece 71 obtained in the present invention is thin, the value of cooling velocity near the solidification point is around 1000 degrees Celsius/s or more, so that the $Nd_2Fe_{14}B$ phases as magnetic phases are produced directly from the liquid phase without γFe as the primary crystals being formed, and an ingot free from a Fe phases can be obtained. Furthermore, the value of the cooling velocity of the cast thin pieces 71 released from the cooling roller 25 (that is, the secondary value of the cooling velocity) can be retarded, and since the distributed state of the R-rich phases can be controlled by regulating the time period in which the cast thin pieces 71 are pushed in between the cooling teeth $\mathbf{51}_1$, $\mathbf{51}_2$, - - - , $\mathbf{51}_n$ by using the pushing teeth $\mathbf{61}_1$, $\mathbf{61}_2$, - - - , $\mathbf{61}_n$, alloys for highly magnetized type magnets to highly magnetic coercive force type magnets can be widely produced. Moreover, since the cooling time can be shortened as a whole, the productivity is improved.

Since the solidification speed is higher as compared to an ingot having a thickness of around 30 mm obtained by a system in which casting is carried out by using a conventionally ordinary mold, the Nd-rich phases included in the cast thin pieces 71 and the crushed small pieces 72 are finely distributed.

This Nd-rich phase becomes a liquid phase at the time of sintering in the magnet producing process, which promotes the increase in the density owing to a so-called liquid phase sintering. Further, in the sintered magnet, the Nd-rich phase contributes to the increase in the magnetic coercive force by magnetically shielding the $Nd_2Fe_{14}B$ magnetic phases. For this reason, when the Nd-rich phases are more finely and uniformly spaced in the raw material alloy, the dispersed distribution state is also improved even in the state of the fine powder crushed in the producing step of the magnet, which serves to improve the magnetic characteristics.

Furthermore, in the neodymium based magnet which can be used in the present invention, heat resistance and economic efficiency can be improved by adding Dy or Pr besides Nd to the raw materials so as to partially replace Nd.

Furthermore, a part of Fe can be replaced by Co or another transition metal element which has the effects of increasing the Curie point and improving the corrosion resistance in many cases.

In addition, R can be used instead of Nd, and T can be used instead of Fe. In this case, the $Nd_2Fe_{14}B$ phase is changed to a $R_2T_{14}B$ phase, and the Nd-rich phase can be expressed as an R-rich phase.

The behavior of the R-rich phases in the cast thin piece 71 during the casting will be explained in more detail. That is, the R-rich phases are expelled from solidification interfaces together with the growth of the $R_2T_{14}B$ phases as the main phases at the time of cooling on the cooling roller 25, and the R-rich phases are produced in a lamellar form inside crystal grains of the $R_2T_{14}B$ phases, partially formed in grain boundaries.

The melting point of the R-rich phase is around 660 degrees Celsius in an Nd—Fe—B ternary equilibrium diagram, for example, and it is considerably lower as compared to the surface temperature of the liquid phase of the magnet constituting alloy. On the other hand, in the casting condition of the SC method like the present invention, the average temperature of the cast thin piece 71 is 700 degrees Celsius or more at the time when it leaves the cooling roller 25, and the R-rich phase is still in the liquid phase state.

The diffusion of atoms in the liquid phase or via the liquid phase is generally several orders of magnitude faster as compared to a diffusion phenomenon in a solid phase. Accordingly, the form of the R-rich phases in the cast thin piece 71 dramatically changes, depending upon the value of cooling velocity of the cast thin piece 71 after released thereof from the cooling roller 25.

When the value of cooling velocity is low, the R-rich phases are slightly rounded through shrinkage of the lamella so as to reduce an interface energy between the R-rich phases and the mother phase. Moreover, with the decrease of temperature, the concentration of R in the R-rich phases increases, and the volume ratio of the R-rich phases decreases.

On the other hand, in the case where the value of the cooling velocity is large, there is a tendency for the higher temperature state immediately after the release from the roller to become frozen; that is, the lamella state immediately after the solidification is kept as it is, and a secondary lamellar is also clearly recognized in a sectional tissue of the cast thin pieces 71 in addition to the primary lamellar. In such a case, the volume ratio of the R-rich phase is large, and the concentration of R in the R-rich phase decreases.

For example, when a sectional tissue of a cast thin piece 71 is observed based on a reflection electron image with a scanning electron microscope, the above state can be quantitatively evaluated by a line segment method in which a line segment of a length of L is drawn on the obtained microscope photograph (composition image), the number N of points at which the segment crosses Nd-rich phases is counted, and the average distance L/N of the R-rich phases is determined through dividing the length L of the line segment by N. The above-obtained value becomes smaller, as the value of the cooling velocity after the release of the cast thin piece 71 from the cooling roller 25 increases.

In this manner, when the existing state of the R-rich phases changes, hydrogenation and a finely crushing step in the magnet producing process are influenced as discussed below, and the characteristics of the obtained magnet are influenced.

In the production of the sintered magnet, hydrogenation crushing treatment (HD treatment) is generally performed before crushing is finely performed by using a crusher (such as, a jet mill or the like). The alloy for the $R_2T_{14}B$ based magnet is likely to absorb hydrogen, and particularly the R-rich phases are likely to absorb hydrogen, so that a hydride is produced so as to cause a volume expansion. Consequently, fine cracks are formed inside the alloy by a wedge effect of the volume expansion and embrittlement of the hydrogenation.

For this reason, when the value of the cooling velocity after the release of the cast thin piece from the cooling roller 25 is large and the intervals of the R-rich phases are narrow, it tends to be finely cracked. Also, if the average grain diameter of the crushed powdery grains is too small, the powder becomes more active so that it becomes more flammable in the air atmosphere or that the concentration of oxygen, which is harmful to the magnetic characteristics of the obtained magnet, tends to increase. In addition, as the powder becomes finer, the orientation degree is more likely to decrease on molding in a magnetic field, which is likely to cause a problem in that the magnetic characteristics, particularly the magnetization, decrease.

For this reason, one generally tends to dislike the alloy rapidly cooled immediately after the release of the cast thin piece 71 from the cooling roller 25, as the raw material alloy for the magnets. More particularly, when the value of the cooling velocity is too large, which the concentrations of R in the R-rich phases are too low, the hydrogenation reaction is unlikely to occur or occurs too slowly, which may cause a problem in the production process.

However, when molding in the magnetic field and further vacuum sintering are carried out by using a powder having a finer grain diameter distribution, a magnet having a finer grain diameter distribution can be obtained, and a magnet having a greater magnetic coercive force is more producible. Therefore, the cast thin piece 71 having small intervals between the R-rich phases is suitable as a raw material alloy for a magnet having a high magnetic coercive force to be used in, for example, a motor or the like. As discussed above, however, too large a value of the cooling velocity is not suitable even in that case, and a cast thin piece 71, having tissues in which a secondary lamellar of the R-rich phases is moderately lost by cooling at an appropriately small value of the cooling velocity in a high temperature range after the release from the cooling roller, is more suitable.

When the value of the cooling velocity of the cast thin piece 71 after being released from the cooling roller is small, there is a tendency for the intervals between the R-rich phases to increase and for the average of grain diameter of the crushed grains after the finely crushing treatment to become greater. In such a case, the orientation degree is more easily increased on the orientation in the magnetic field; and thus, the alloys having such tissues tend to be desired in the production of magnets having large magnetization to be used in, for example, voice coil motors (VCM) which are head actuators for hard disc drives (HDD). As discussed above, according to the SC method, since the distribution state of the R-rich phases, which has a serious influence on the magnetic characteristics, needs to be controlled. For this purpose, it is important to control the cooling condition after the cast thin piece 71 is released from the cooling roller. More particularly, it is important to control the temperature in the high temperature range of the melting point of the R-rich phases and more.

In the present invention, when the cooling on the cooling roller 25 is the primary cooling, whereas the cooling of the cast thin piece 71 after the release from the cooling roller 25 is separately the secondary cooling, the secondary value of the cooling velocity can be controlled in the present invention by changing the time period during the cast thin pieces 71 and the crushed small pieces 72 are placed on the cooling teeth $\mathbf{51}_1, \mathbf{51}_2, ---, \mathbf{51}_n$, and the temperature and the flow rate of the cooling water that flows in the cooling pipes for the cooling teeth $\mathbf{51}_1, \mathbf{51}_2, ---, \mathbf{51}_n$. Thus, cooling can be performed at the value of the cooling velocity in the range of 50 degrees Celsius/min. to 2×103 degrees Celsius/min, which is lower than the solidus temperature of the alloy (the solidification completion temperature=the ternary eutectic temperature).

What is claimed is:

1. A secondary cooling apparatus, comprising:

a vessel;

a comb tooth-shaped device in which a plurality of plate-like cooling teeth are provided upright at a predetermined interval;

a pressing device having a plurality of pressing teeth to be inserted between the cooling teeth; and cooling pipe provided on the cooling teeth and a liquid cooling medium flows through the cooling pipe.

2. The secondary cooling apparatus according to claim 1, wherein the vessel is formed in a bottomed cylindrical shape, and the cooling teeth are each formed in a ring shape and concentrically arranged.

3. A casting apparatus, comprising:

a crucible in which a melt of a raw material is placed;

a primary cooling apparatus for cooling the melt fed from the crucible and forming a plate-like cast thin piece;

and a secondary cooling apparatus, wherein the cast thin piece is fed into the secondary cooling apparatus, and wherein the secondary cooling apparatus includes:

a vessel, a comb tooth-shaped device in which a plurality of plate-like cooling teeth are provided upright at a predetermined interval, a pressing device having a plurality of pressing teeth to be inserted between the cooling teeth, and cooling pipe provided on the cooling teeth and a liquid cooling medium flows through the cooling pipe.

4. The casting apparatus according to claim 3, further comprising:

a crushing device for crushing the cast thin piece and forming crushed small pieces, wherein both the cast thin piece and the crushed small pieces can be fed to the secondary cooling apparatus.

* * * * *